US006350081B1

(12) United States Patent
Khajavi et al.

(10) Patent No.: US 6,350,081 B1
(45) Date of Patent: Feb. 26, 2002

(54) MANHOLE RESTRAINING SYSTEM FOR VENTING OUT EXPLOSIVE GASES IN A MANHOLE

(75) Inventors: Mohammed B. Khajavi, Lakewood; Sa'id S. Poosti, Tarzana, both of CA (US)

(73) Assignee: Department of Water and Power City of Los Angeles, Los Angeles, CA (US)

( * ) Notice: Subject to any disclaimer, the term of this patent is extended or adjusted under 35 U.S.C. 154(b) by 0 days.

(21) Appl. No.: 09/626,544

(22) Filed: Jul. 25, 2000

(51) Int. Cl.[7] ..... E02D 29/14

(52) U.S. Cl. ..... 404/25; 49/21

(58) Field of Search ..... 404/25; 49/21; 52/20; 137/43

(56) References Cited

U.S. PATENT DOCUMENTS

| | | | | |
|---|---|---|---|---|
| 1,071,577 A | | 8/1913 | Rego | |
| 1,717,364 A | | 6/1929 | Borland | |
| 1,955,018 A | | 4/1934 | Rego | |
| 2,009,132 A | | 7/1935 | Gehris | |
| 2,025,839 A | | 12/1935 | Woods, Jr. | |
| 2,553,934 A | | 5/1951 | Olyott | |
| 3,712,009 A | * | 1/1973 | Campagna | 52/20 |
| 3,969,847 A | * | 7/1976 | Campagna et al. | 52/1 |
| 4,508,131 A | * | 4/1985 | DeFrees | 137/43 |
| 4,514,931 A | | 5/1985 | Beck et al. | |
| 5,135,024 A | * | 8/1992 | LeBlanc et al. | 137/529 |
| 5,275,292 A | * | 1/1994 | VanDeVyvere | 137/492 |
| 5,344,253 A | | 9/1994 | Sacchetti | |
| 5,511,575 A | * | 4/1996 | Andenmatten et al. | 137/43 |
| 5,628,152 A | * | 5/1997 | Bowman | 52/20 |

OTHER PUBLICATIONS

Anderson, Greenwood & Company on–line catalogue, Pressure Relief Devices A Total Capability, Sep. 1995, 8 pages, from www.andersongreenwood.com.*

* cited by examiner

*Primary Examiner*—David Bagnell
*Assistant Examiner*—Katherine Mitchell
(74) *Attorney, Agent, or Firm*—Thomas I. Rozsa; Tony D. Chen; Jerry Fong

(57) ABSTRACT

A manhole restraining system used for venting out explosive gases in a manhole caused by an explosion. The manhole restraining system comprises a support frame, a two inch thick plate member positioned on top of the support frame, a plurality of restraining assemblies and a manhole cover for covering the manhole. The support frame and the plate member are embedded into a street and positioned above the manhole, where openings are aligned with the manhole. Three retaining assemblies are positioned on opposite sides of the manhole cover. Each retaining assembly includes a rod, a stop plate, a coil spring, a support plate and a nut. The rod extends downwardly through the dirt and the horizontal concrete base ledge, where the stop plate, the coil spring, the support plate and the nut are positioned and secured to the other end of the rod. A PVC pipe is provided with the rod for allowing the rod to move smoothly up and down without any friction. When an explosion occurs in the manhole, the pressure caused by the explosion lifts the plate member from a seated position on the main support frame above the manhole which in turn upwardly moves the rod, the stop plate, the coil spring, the support plate and the nut, where the explosive gases are vented out between the plate member and the main support frame. The stop plate, coil spring, the support plate and the nut absorb most of the energy caused by the explosion. The spring softens the impact and assist in bringing the plate member back down to the main support frame in alignment with the manhole.

19 Claims, 4 Drawing Sheets

MANHOLE RESTRAINING SYSTEM FOR VENTING OUT EXPLOSIVE GASES IN A MANHOLE

BACKGROUND OF THE INVENTION

1. Field of the Invention

The present invention generally relates to the field of safety devices for manholes. More particularly, the present invention relates to the field of manhole cover systems used in connection with underground electrical systems.

2. Description of the Prior Art

Specifically, when a power distribution system in a manhole fails, electrical failure and buildup of gases can cause an explosion in the manhole. In such an event the manhole cover is hurled high in the air, which is likely to cause damage or loss of life due to the manhole cover. To prevent this from happening, prior art provision was made whereby when such an explosion occurs the manhole cover is limited in its upward movement, with means being employed to prevent it from being hurled into the air. The prior art approach is to restrain the manhole cover while relieving the pressure caused by an explosion. The disadvantage with this prior art approach is that the casting or the neck section will be taking the entire load, which is not sufficient to hold the load. The prior art designs cannot take the force of an explosion resulting from an electrical arc at voltages above 110,000 volts.

The following eight (8) prior art patents are found to be pertinent to the field of the present invention:

1. U.S. Pat. No. 1,071,577 issued to Rego on Aug. 26, 1913 for "Device For Preventing Blowing Off Of Manhole Covers" (hereafter "the '577 Rego Patent");

2. U.S. Pat. No. 1,717,364 issued to Borland on Jun. 18, 1929 for "Safety Device For Manhole Covers Or The Like" (hereafter the "Borland Patent");

3. U.S. Pat. No. 2,009,132 issued to Gehris on Jul. 23, 1935 for "Manhole Construction" (hereafter the "Gehris Patent");

4. U.S. Pat. No. 2,025,839 issued to Woods, Jr. on Dec. 31, 1935 for "Manhole Closure" (hereafter the "Woods Patent");

5. U.S. Pat. No. 1,955,018 issued to Rego on Apr. 17, 1934 for "Safety Device For Manhole Covers" (hereafter "the '018 Rego Patent");

6. U.S. Pat. No. 2,553,934 issued to Olyott on May 22, 1951 for "Manhole Cover Construction" (hereafter the "Olyott Patent");

7. U.S. Pat. No. 4,514,931 issued to Beck et al. on May 7, 1985 for "Securing Device For Manhole Cover" (hereafter the "Beck Patent"); and 8. U.S. Pat. No. 5,344,253 issued to Sacchetti on Sep. 6, 1994 for "Adjustable Manhole Cover" (hereafter the "Sacchetti Patent").

The '577 Rego Patent discloses a device for preventing manhole cover from blowing off. The cover has a plurality of downward extensions with opening therethrough, in which a nut is positioned. Secured to the wall of the manhole are guide members, through which reciprocating rods extend, with the upper end of each rod threaded to the nut. The lower end of each rod has a head and there is a guide member spaced apart from the head with a helical spring surrounding the rod member interposed between the guide member and the head. Each rod has a shoulder which limits the downward movement of the rod in the guide members when the rods are disengaged from their nuts. While the parts are in position and when gases accumulate in the manhole, the cover would be raised sufficiently against the tension of the springs to permit escape of the gases, after which the springs would return the cover to its normal closed position.

The Borland Patent discloses a safety device for manhole covers or the like.

The Gehris Patent discloses a manhole construction.

The Woods Patent discloses a manhole closure.

The '018 Rego Patent discloses a safety device for manhole covers. The cover is adapted to close the manhole which has recesses formed in the sidewall. A tubular member is disposed in each recess, with its upper end secured to an annular seat. The tubular member has a partition, where the lower end has a closure. A piston is adapted to reciprocate within the tubular member and is located between the closure and partition. A helical spring is located between the partition and piston, where the piston is threaded to the lower end of a rod extending upwardly through the partition and having at its upper end a nut extending through the cover. The piston can be adjusted lengthwise of the rod to vary the tension of the spring and then locked in adjusted position by nuts. Surrounding the tubular member are anchors extending outwardly between the bricks forming the walls of the manhole, thereby preventing any upward movement of the tubular member. When an explosion takes place within the manhole, the cover is raised from its seat to a limited distance, such that the springs are being compressed during this upward movement of the cover. During the lifting of the cover, the gas within the manhole will escape and then the springs will return the cover to its normal position. During the lifting of the cover, the disk will operate a movable member of the switch to illuminate a lamp and signal that an explosion has occurred.

The Olyott Patent discloses a manhole cover construction. It comprises a cover supported by a seat element which is separate from a housing. The seat element has a seat portion on which the cover rests. The seat element is normally supported by inwardly projecting lugs which are provided by the housing. The seat element has a plurality of pins, where each pin is provided at its lower end with a head. The pins extend loosely through the projecting lugs. Situated between the head of each pin and the corresponding projection is a spring which encircles the pin. The seat element is releaseably secured to the manhole and whenever an abnormal pressure develops within the manhole, the seat element will raise in order to vent the manhole.

The Beck Patent discloses a securing device for a manhole cover.

The Sacchetti Patent discloses an adjustable manhole cover.

It is highly desirable to have a very efficient and also very effective design and construction of a manhole restraining system for venting out explosive gases in a manhole, thereby eliminating the damage cause by flying manhole covers. It is desirable to provide a manhole restraining system for venting out explosive gases in a manhole in a much more efficient way. It is also desirable to provide a manhole restraining system which prevents the buildup of explosive gases caused by an electrical failure in the manhole.

SUMMARY OF THE INVENTION

The present invention is a manhole restraining system used for venting out explosive gases in a manhole caused by an explosion.

The manhole restraining system comprises a main support frame, a two inch thick plate member positioned on top of the support frame, a plurality of restraining assemblies and a manhole cover for covering the manhole. The support frame and the plate member are embedded into a street and positioned above the manhole, where openings are aligned with the manhole. Asphalt covers the plate member and the support frame. Three retaining assemblies are positioned on opposite sides of the manhole cover. Each retaining assembly includes a rod, a stop plate, a coil spring, a support plate and a nut. The rod extends downwardly through the dirt and the horizontal concrete base ledge, where the stop plate, the coil spring, the support plate and the nut are positioned and secured to the other end of the rod. A PVC pipe is provided with the rod for allowing the rod to move smoothly up and down without any friction.

When an explosion occurs in the manhole, the pressure caused by the explosion lifts the plate member from a seated position on the main support frame above the manhole which in turn moves the rod, the stop plate, the coil spiring, the support plate and the nut, where the explosive gases are vented between the plate member and the main support frame. What happens is that the plate member is lifted up from the main support frame, where it breaks away from the asphalt which allows the gases to escape from the manhole. The stop plate, coil spring, the support plate and the nut absorb most of the energy caused by the explosion. The spring means soften the impact and helps bring the plate member back down to the main support frame in alignment with the manhole.

It is an object of the present invention to provide a manhole restraining system for venting out explosive gases caused by an explosion in the manhole, thereby eliminating the damage caused by a flying manhole cover.

It is also an object of the present invention to provide a manhole restraining system which includes a plurality of restraining assemblies, where each restraining assembly includes a stop plate, a coil spring, a support plate and a nut which absorb most of the energy caused by the explosion.

It is an additional object of the present invention to provide a manhole restraining system, where the coil springs soften the impact and assist in bringing the plate member back down to the main support frame in alignment with the manhole.

It is a further object of the present invention to provide a manhole restraining system for limiting the upward movement of the manhole restraining system when an explosion occurs in the manhole.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 4:
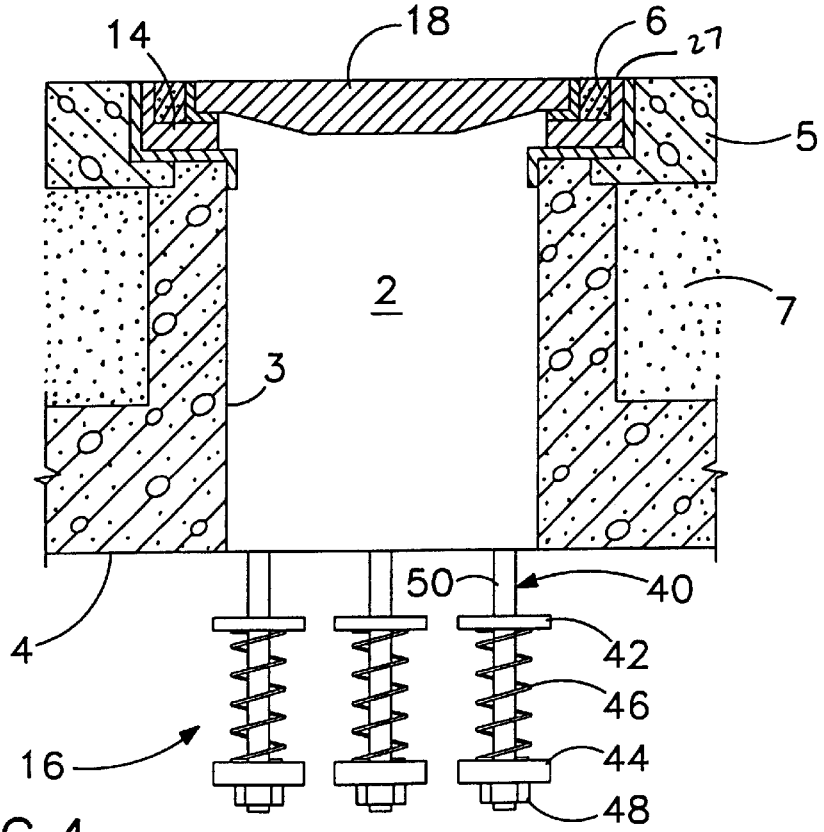
FIG. 4 is a cross-sectional view taken along line 4—4 of FIG. 2.
Figure 5:
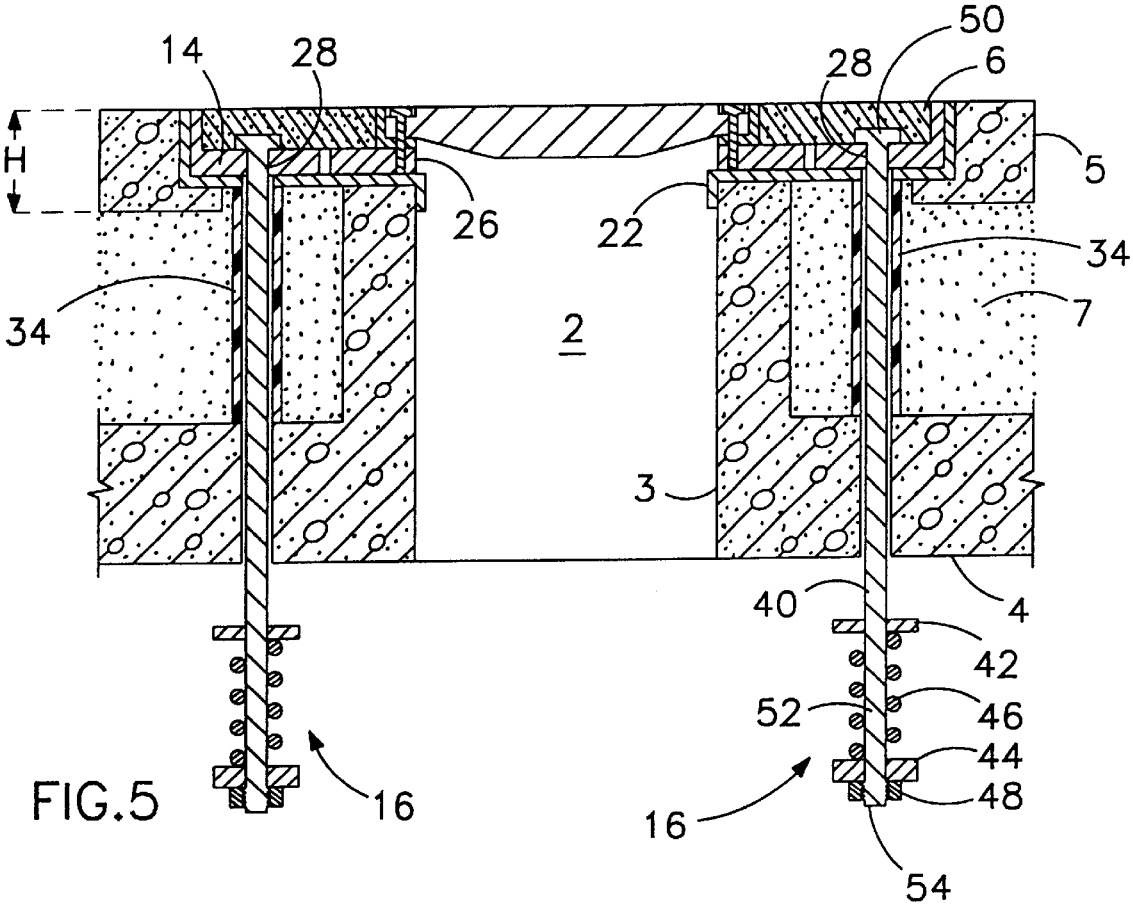
FIG. 5 is a cross-sectional view taken along line 5—5 of FIG. 2.
Figure 7:
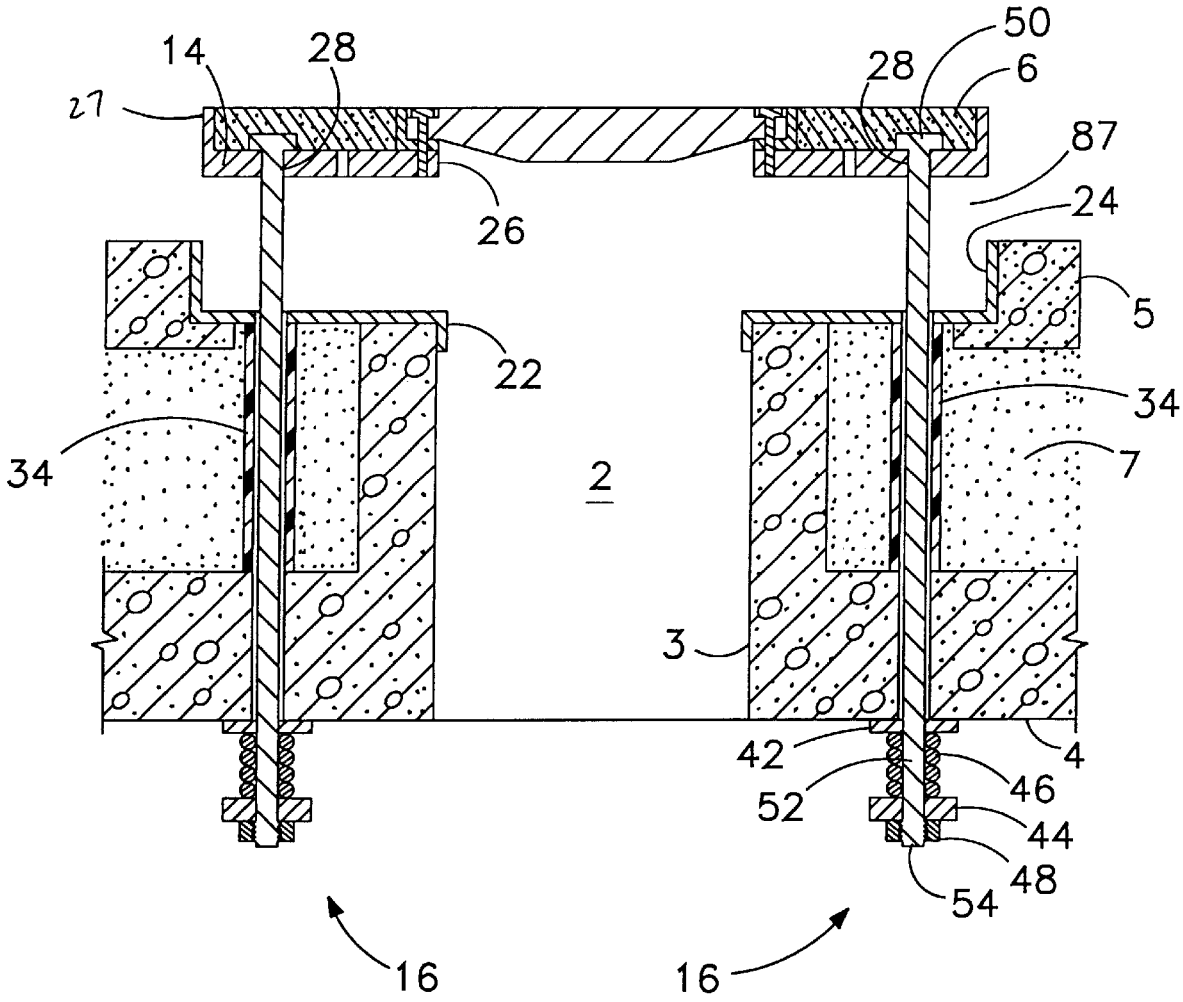
FIG. 7 is a cross-sectional view similar to FIG. 5, showing the present invention manhole restraining system lifted up during an explosion.

Referring to FIGS. 1, 4, 5 and 7, there is shown at 10 the present invention manhole restraining system for venting out explosive gases in a vertical manhole tunnel 2 (see FIGS. 5 and 7) which is conventionally constructed from a vertical concrete cylindrical wall 3 that connects to a horizontal concrete base ledge 4, where dirt 7 surrounds the exterior of the manhole tunnel 2 (see FIGS. 4, 5 and 7). The vertical manhole tunnel 2 connects directly to underground conduit systems, where a power distribution system is located for a metropolitan area and is therefore fixed in elevational position.

The manhole restraining system 10 is set below pavement of a street and directly positioned over the manhole tunnel 2 and is surrounded and supported by a concrete collar 5 which is conventionally constructed. Once the manhole restraining system 10 is in position, asphalt or pavement material 6 is provided around and on top of the manhole restraining system 10 covering it and only leaving the manhole cover uncovered.

Referring to FIGS. 1 through 7, the manhole restraining system 10 comprises a generally rectangular shaped main steel support frame 12, a two inch thick steel plate member 14 positioned on top of the support frame 12, a plurality of vertical restraining assemblies 16, and a circular shaped removable manhole cover 18 made of a high strength cast iron.

Figure 3:
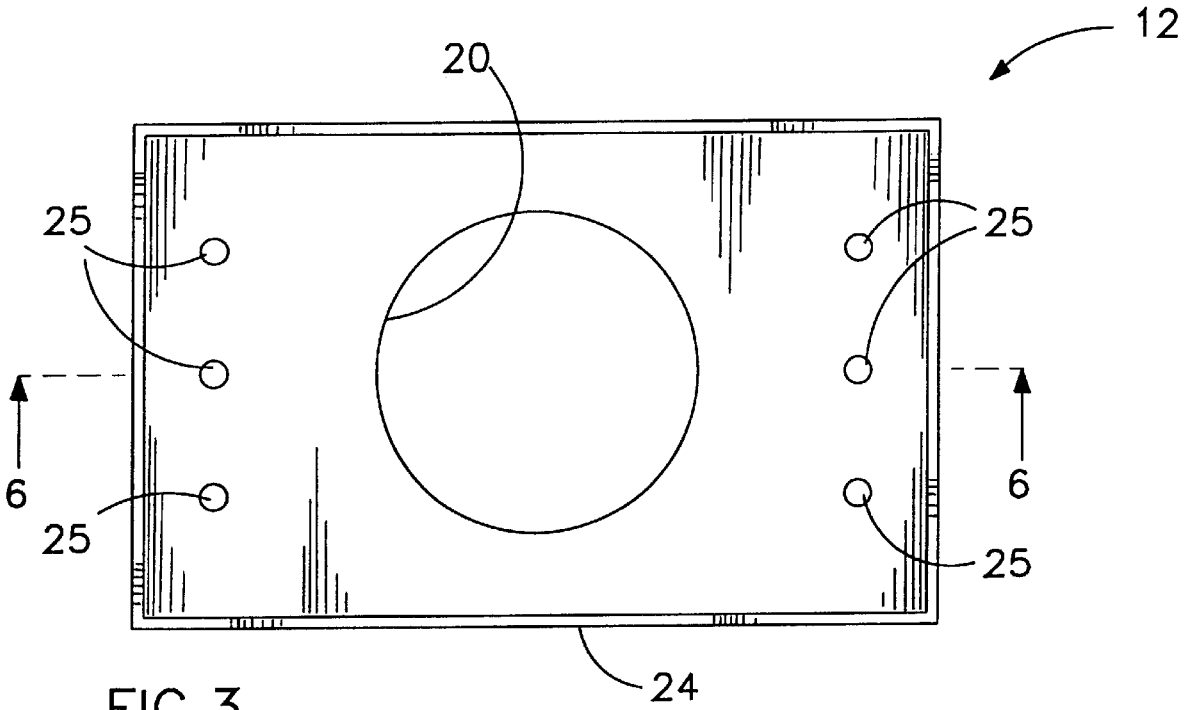
FIG. 3 is a top plan view of a support frame of the present invention manhole restraining system for venting out explosive gases in a manhole.
Figure 6:
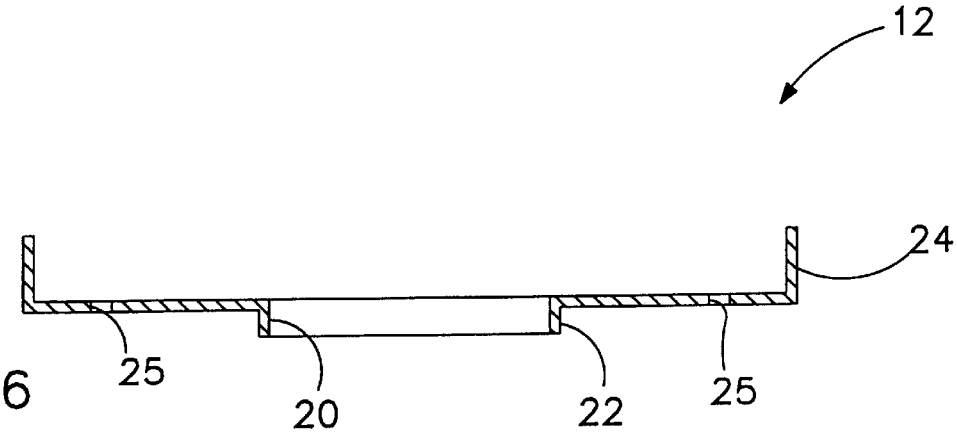
FIG. 6 is a cross-sectional view taken along line 6—6 of FIG. 3.

Referring to FIGS. 3 and 6, the support frame 12 has a circular shaped central opening 20 extending therethrough, a downwardly annular flange collar 22 surrounding the central opening 20, an upwardly perimeter flange wall 24, and a plurality of mounting apertures 25 extending therethrough. The downwardly annular flange collar 22 provides an anchor base for the support frame 12 to be secured in place within the manhole tunnel 2. Three spaced apart mounting apertures 25 are located on each opposite side of the central opening 20. The support frame 12 acts like a frame for the thick plate member 14.

Referring to FIGS. 1, 2, 4 and 5, the thick plate member 14 has a circular shaped central opening 26, an upwardly perimeter flange wall 27 and a plurality of mounting apertures 28. Three spaced apart mounting apertures 28 are located on each opposite side of the central opening 26.

There are provided two threaded lifting holes 29 located on each opposite side of the central opening 26. The thick plate member 14 is seated and positioned to the upper surface of the support frame 12, such that the central opening 26 and the plurality of mounting apertures 28 are respectively aligned with the central opening 20 and the plurality of mounting apertures 25 of the support frame 12. An annular angle flange 30 is provided and positioned to the top of the plate member 14 by welding means or other conventional means and surrounds the central opening 20.

Access to the manhole tunnel 2 is through the removable manhole cover 18 which is seated on the annular angle flange 30 provided in accordance with the present invention. The manhole cover 18 is secured by a plurality of spaced apart threaded bolts 55 which are threadedly engaged to the thick plate member 14. The removable manhole cover 18 and the annular angle flange 30 are flush with the pavement surface 6.

Referring to FIGS. 4, 5 and 7, each vertical restraining assembly 16 comprises an elongated rod 40, an upper slidable stop plate 42, a lower fixed support plate 44, a heavy duty compression spring means 46, and a nut 48. The rod 40 has a head portion 50 and a shaft portion 52 with threads 54 at the lower part of the shaft portion 52, where the nut 48 is threadedly engaged and secured thereto by welding means or other suitable means. The lower fixed support plate 44 is positioned around the lowermost part of the shaft portion 52 and welded on top of the nut 48. The upper slidable stop plate 42 is positioned and secured on top of the compression spring means 46 by welding means and both surround the lower part of the shaft portion 52 of the rod 40, where the bottom of the compression spring means 46 abuts against the lower fixed support plate 44. The rods 40 are respectively inserted through the respective mounting apertures 25 and 28 of the support frame 12 and the plate member 14, and through PVC pipes or tubes 34 provided thereto. The PVC pipes 34 are provided with the elongated rods 40 for allowing the rods 40 to move smoothly up and down without any friction caused by the dirt 7. The head portions 50 of the rods 40 abut against the upper surface of the two inch thick plate member 14 while the lower parts of the shaft portions 52 extend through the horizontal concrete base 4.

Referring to FIG. 7, when an explosion occurs in the manhole 2, the pressure caused by the explosion moves and lifts the plate member 14 from the seated position upwardly away from the main support frame 12 to a limited predetermined distance above the manhole tunnel 2 which in turn moves the rods upwardly. The upper slidable stop plates 42 strike against the bottom of the horizontal concrete base ledge 4, where the compression spring means 46 are compressed enough such that the plate member 14 is lifted upwardly to the limited predetermined distance to provide a gap between the plate member 14 and the support frame 12 to allow the explosive gases to escape from the manhole 2. What happens is that the thick plate member 14 is lifted up from the seated position (as shown), where it breaks away from the asphalt or pavement member 6 and forms a gap 87 to allow the explosive gases to escape from the manhole tunnel 2. The thick plate member 14 and the lower parts of the restraining assemblies 16 absorb most of the energy caused by the explosion. The compression spring means 46 soften the impact and assist in bringing the thick plate member 14 back down to the support frame 12 in alignment with the manhole tunnel 2.

Figure 1:
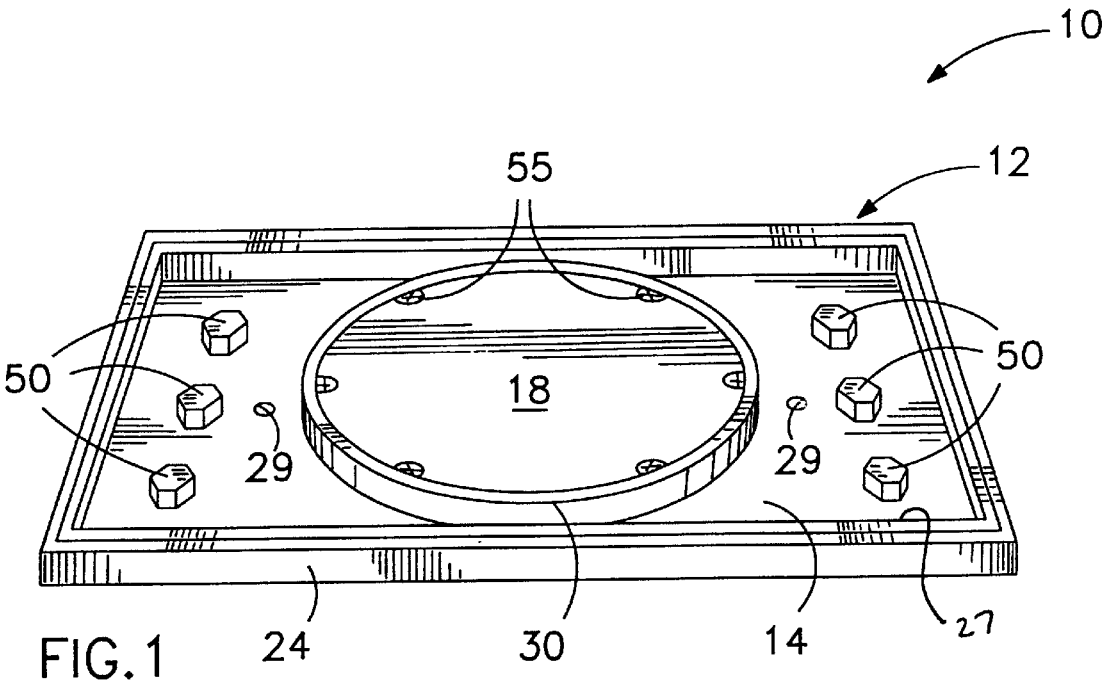
FIG. 1 is a perspective view of the present invention manhole restraining system for venting out explosive gases in a manhole.
Figure 2:
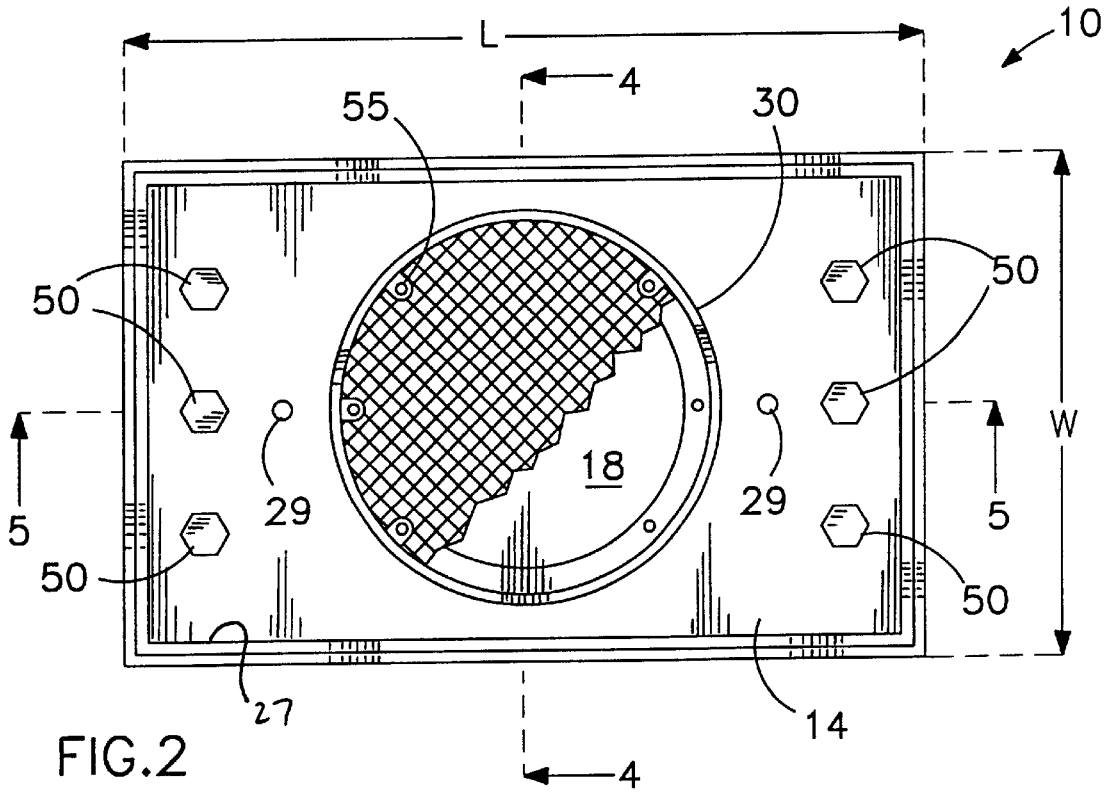
FIG. 2 is a top plan view of the present invention manhole restraining system for venting out explosive gases in a manhole.

Referring to FIGS. 2 and 5, by way of example, the overall length L, width W and height H of the manhole restraining system 10 are approximately 5 feet 6 inches by 3 feet 6 inches by 8 inches respectively. It will be appreciated that the dimensions described above are merely one illustrative embodiment and can include many other comparable sets of dimensions.

The present invention conforms to conventional forms of manufacture or any other conventional way known to one skilled in the art.

Defined in detail, the present invention is a manhole restraining system set below pavement of a street and used in conjunction with a manhole for venting out explosive gases in the manhole, the system comprising: (a) a generally rectangular shaped main support frame having a central opening, an annular flange collar surrounding the central opening and extending downwardly therefrom, and three pairs of spaced apart mounting apertures extending therethrough and located on opposite sides of the central opening, the main support frame being positioned over the manhole such that the central opening is aligned with the manhole; (b) a generally rectangular shaped plate member having a central opening, and three pairs of spaced apart mounting apertures extending therethrough and located on opposite sides of the central opening, the plate member positioned on top of the support frame such that the central opening and the three pairs of mounting apertures are respectively aligned with the central opening and the three pairs of mounting apertures of the support frame; (c) an annular angle flange positioned and secured to the plate member and surrounding the central opening; (d) a manhole cover seated and secured to the annular angle flange and sized to cover the central openings of the support frame and the plate member leading to the manhole; (e) a plurality of restraining assemblies, each having an elongated rod, an upper slidable stop plate, a coil spring, a lower fixed support plate and a nut; (f) the elongated rod of the each restraining assembly having a head portion and a shaft portion, the shaft portion respectively inserted through the each aperture of the plate member and the support frame such that the head portion abuts against an upper surface of the plate member and the shaft portion extends through a horizontal concrete base ledge of the manhole; (g) the nut of the each restraining assembly respectively and threadedly engaged with the elongated rod and secured thereto; (h) the lower fixed support plate of the each restraining assembly positioned around the elongated rod and secured to the nut; (i) the coil spring of the each restraining assembly surrounding a lowermost part of the rod; (j) the upper slidable stop plate of the each restraining assembly secured on top of the coil spring and around the elongated rod; and (k) means for allowing the rod of the each restraining assembly to move smoothly up and down without any friction; (1) whereby when an explosion occurs in the manhole, the pressure caused by the explosion lifts the plate member away from the support frame which in turn moves the rod of the each restraining assembly upwardly such that the upper slidable stop plate of the each restraining assembly strikes against the bottom of the horizontal concrete base ledge, where the coil spring of the each restraining assembly is compressed such that the plate member is lifted upwardly to a limited predetermined distance to form a gap between the plate member and the support frame to allow the explosive gases to escape from the manhole, and after all of the explosive gases have escaped, the coil spring of the each restraining assembly is uncompressed forcing down the plate member to the support frame back into alignment with the manhole.

Defined broadly, the present invention is a manhole restraining system set below pavement of a street and used in conjunction with a manhole for venting out explosive gases in the manhole, the system comprising: (a) a plate member having an opening, and at least three pairs of spaced apart mounting apertures extending therethrough and located on opposite sides of the opening, the plate member being positioned above the manhole such that the opening is aligned with the manhole; (b) an angle flange positioned and secured to the plate member and surrounding the opening; (c) a manhole cover seated and secured to the angle flange and sized to cover the opening of the plate member leading to the manhole; (d) a plurality of restraining assemblies, each having an elongated rod, an upper slidable stop plate, spring means, a lower fixed support plate and a nut; (e) the elongated rod of the each restraining assembly having a head portion and a shaft portion, the shaft portion respectively inserted through the each aperture of the plate member such that the head portion abuts against an upper surface of the plate member and the shaft portion extends through a base ledge of the manhole; (f) the nut of the each restraining assembly respectively and threadedly engaged with the elongated rod and secured thereto; (g) the lower fixed support plate of the each restraining assembly positioned around the elongated rod and secured to the nut; (h) the spring means of the each restraining assembly surrounding a lowermost part of the rod; (i) the upper slidable stop plate of the each restraining assembly secured on top of the spring means and around the elongated rod; and (j) means for allowing the rod of the each restraining assembly to move smoothly up and down without any friction; (k) whereby when an explosion occurs in the manhole, the pressure caused by the explosion lifts the plate member from a seated position which in turn moves the rod of the each restraining assembly upwardly such that the upper slidable stop plate of the each restraining assembly strikes against the bottom of the base ledge, where the spring means of the each restraining assembly is compressed such that the plate member is lifted upwardly to a limited predetermined distance to form a gap between the pavement and the plate member to allow the explosive gases to escape from the manhole, and after all of the explosive gases have escaped, the spring means of the each restraining assembly is uncompressed forcing down the plate member back into alignment with the manhole.

Defined more broadly, the present invention is a manhole restraining system set below pavement of a street and used in conjunction with a manhole for venting out explosive gases in the manhole, the system comprising: (a) a plate member having an opening, and at least one pair of mounting apertures extending therethrough and located on opposite sides of the opening, the plate member being positioned above the manhole such that the opening is aligned with the manhole; (b) a manhole cover sized to cover the opening of the plate member leading to the manhole and removably secured thereto; (c) at least two restraining assemblies, each having a rod, an upper plate, a spring means, a lower plate and a nut; (d) the rod of the each restraining assembly having a head portion and a shaft portion, the shaft portion respectively inserted through the each aperture of the plate member such that the head portion abuts against an upper surface of the plate member and the shaft portion extends through a base ledge of the manhole; (e) the nut of the each restraining assembly respectively secured to the shaft portion of the rod; (f) the lower plate of the each restraining assembly positioned around the rod and secured to the nut; (g) the spring means of the each restraining assembly surrounding the shaft portion of the rod; and (h) the upper plate of the each restraining assembly secured on top of the spring means and around the shaft portion of the rod; (i) whereby when an explosion occurs in the manhole, the pressure caused by the explosion lifts the plate member from a seated position which in turn moves the rod of the each restraining assembly upwardly such that the upper plate of the each restraining assembly strikes against the bottom of the base ledge, where the spring means of the each restraining assembly is compressed such that the plate member is lifted upwardly to a limited predetermined distance to form a gap between the pavement and the plate member to allow the explosive gases to escape from the manhole, and after all of the explosive gases have escaped, the spring means of the each restraining assembly is uncompressed forcing down the plate member back into alignment with the manhole.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A manhole restraining system set below pavement of a street and used in conjunction with a manhole for venting out explosive gases in the manhole, the system comprising:

a. a generally rectangular shaped main support frame having a central opening, an annular flange collar surrounding the central opening and extending downwardly therefrom, and three pairs of spaced apart mounting apertures extending therethrough and located on each opposite side of the central opening, the main support frame being positioned over said manhole such that said central opening is aligned with said manhole;

b. a generally rectangular shaped plate member having a central opening, and three pairs of spaced apart mounting apertures extending therethrough and located on each opposite side of the central opening, the plate member positioned on top of said support frame such that the central opening and the three pairs of mounting apertures are respectively aligned with said central opening and said three pairs of mounting apertures of said support frame;

c. an annular angle flange positioned and secured to said plate member and surrounding said central opening;

d. a manhole cover seated and secured to said annular angle flange and sized to cover said central openings of said support frame and said plate member leading to said manhole;

e. a plurality of restraining assemblies, each having an elongated rod, an upper slidable stop plate, a coil spring, a lower fixed support plate and a nut;

f. said elongated rod of said each restraining assembly having a head portion and a shaft portion, the shaft portion respectively inserted through said each aperture of said plate member and said support frame such that said head portion abuts against an upper surface of said plate member and said shaft portion extends through a horizontal concrete base ledge of said manhole;

g. said nut of said each restraining assembly respectively and threadedly engaged with said elongated rod and secured thereto;

h. said lower fixed support plate of said each restraining assembly positioned around said elongated rod and secured to said nut;

i. said coil spring of said each restraining assembly surrounding a lowermost part of said rod;

j. said upper slidable stop plate of said each restraining assembly secured on top of said coil spring and around said elongated rod; and k. means for allowing said rod of said each restraining assembly to move smoothly up and down without any friction;

l. whereby when an explosion occurs in said manhole, the pressure caused by the explosion lifts said plate member away from said support frame which in turn moves said rod of said each restraining assembly upwardly such that said upper slidable stop plate of said each restraining assembly strikes against the bottom of said horizontal concrete base ledge, where said coil spring of said each restraining assembly is compressed such that said plate member is lifted upwardly to a limited predetermined distance to form a gap between said plate member and said support frame to allow the explosive gases to escape from said manhole, and after all of the explosive gases have escaped, said coil spring of said each restraining assembly is uncompressed forcing down said plate member to said support frame back into alignment with said manhole.

2. The system in accordance with claim 1, wherein said coil spring means is a heavy duty compression spring.

3. The system in accordance with claim 1, wherein the thickness of said plate member is approximately two inches.

4. The system in accordance with claim 1, wherein said means for allowing said rod of said each restraining assembly to move smoothly up and down without any friction includes PVC pipe.

5. The system in accordance with claim 1, wherein said manhole cover is made out of high strength cast iron.

6. A manhole restraining system set below pavement of a street and used in conjunction with a manhole for venting out explosive gases in the manhole, the system comprising:

a. a plate member having an opening, and at least three pairs of spaced apart mounting apertures extending therethrough and located on opposite sides of the opening, the plate member being positioned above said manhole such that said opening is aligned with said manhole;

b. an angle flange positioned and secured to said plate member and surrounding said opening;

c. a manhole cover seated and secured to said angle flange and sized to cover said opening of said plate member leading to said manhole;

d. a plurality of restraining assemblies, each having an elongated rod, an upper slidable stop plate, spring means, a lower fixed support plate and a nut;

e. said elongated rod of said each restraining assembly having a head portion and a shaft portion, the shaft portion respectively inserted through said each aperture of said plate member such that said head portion abuts against an upper surface of said plate member and said shaft portion extending through a base ledge of said manhole;

f. said nut of said each restraining assembly respectively and threadedly engaged with said elongated rod and secured thereto;

g. said lower fixed support plate of said each restraining assembly positioned around said elongated rod and secured to said nut;

h. said spring means of said each restraining assembly surrounding a lowermost part of said rod;

i. said upper slidable stop plate of said each restraining assembly secured on top of said spring means and around said elongated rod; and j. means for allowing said rod of said each restraining assembly to move smoothly up and down without any friction;

k. whereby when an explosion occurs in said manhole, the pressure caused by the explosion lifts said plate member from a seated position which in turn moves said rod of said each restraining assembly upwardly such that said upper slidable stop plate of said each restraining assembly strikes against the bottom of said base ledge, where said spring means of said each restraining assembly is compressed such that said plate member is lifted upwardly to a limited predetermined distance to form a gap between the pavement and said plate member to allow the explosive gases to escape from said manhole, and after all of the explosive gases have escaped, said spring means of said each restraining assembly is uncompressed forcing down said plate member back into alignment with said manhole.

7. The system in accordance with claim 6, further comprising a generally rectangular shaped main support frame having an opening, a flange collar surrounding the opening and extending downwardly therefrom, and at least three pairs of spaced apart mounting apertures extending therethrough and located on opposite sides of the opening, the main support frame being between said manhole and said plate member such that said opening is aligned with said manhole and said opening of said plate member.

8. The system in accordance with claim 6, wherein said spring means is a heavy duty compression spring.

9. The system in accordance with claim 6, wherein the thickness of said plate member is approximately two inches.

10. The system in accordance with claim 6, wherein said means for allowing said rod of said each restraining assembly to move smoothly up and down without any friction includes PVC pipe.

11. The system in accordance with claim 6, wherein said manhole cover is made out of high strength cast iron.

12. A manhole restraining system set below pavement of a street and used in conjunction with a manhole for venting out explosive gases in the manhole, the system comprising:

a. a plate member having an opening, and at least one pair of mounting apertures extending therethrough and located on opposite sides of the opening, the plate member being positioned above said manhole such that said opening is aligned with said manhole;

b. a manhole cover sized to cover said opening of said plate member leading to said manhole and removably secured thereto;

c. at least two restraining assemblies, each having a rod, an upper plate, a spring means, a lower plate and a nut;

d. said rod of said each restraining assembly having a head portion and a shaft portion, the shaft portion respectively inserted through said each aperture of said plate member such that said head portion abuts against an upper surface of said plate member and said shaft portion extends through a base ledge of said manhole;

e. said nut of said each restraining assembly respectively secured to said shaft portion of said rod;

f. said lower plate of said each restraining assembly positioned around said rod and secured to said nut;

g. said spring means of said each restraining assembly surrounding said shaft portion of said rod; and h. said upper plate of said each restraining assembly secured on top of said spring means and around said shaft portion of said rod;

i. whereby when an explosion occurs in said manhole, the pressure caused by the explosion lifts said plate member from a seated position which in turn moves said rod of said each restraining assembly upwardly such that said upper plate of said each restraining assembly strikes against the bottom of said base ledge, where said spring means of said each restraining assembly is compressed such that said plate member is lifted upwardly to a limited predetermined distance to form a gap between the pavement and said plate member to allow the explosive gases to escape from said manhole, and after all of the explosive gases have escaped, said spring means of said each restraining assembly is uncompressed forcing down said plate member back into alignment with said manhole.

13. The system in accordance with claim 12, further comprising a generally rectangular shaped main support frame having an opening, a flange collar surrounding the opening and extending downwardly therefrom, and at least one pair of spaced apart mounting apertures extending therethrough and located on opposite sides of the opening, the main support frame being between said manhole and said plate member such that said opening is aligned with said manhole and said opening of said plate member.

14. The system in accordance with claim 12, further comprising an angle flange positioned and secured to said plate member and surrounding said opening for accommodating said manhole cover.

15. The system in accordance with claim 12, wherein said spring means is a heavy duty coil compression spring.

16. The system in accordance with claim 12, wherein the thickness of said plate member is approximately two inches.

17. The system in accordance with claim 12, wherein said plate member is generally a rectangular shape.

18. The system in accordance with claim 12, further comprising means for allowing said rod of said each restraining assembly to move smoothly up and down without any friction.

19. The system in accordance with claim 18, wherein said means for allowing said rod of said each restraining assembly to move smoothly up and down without any friction includes PVC pipe.

* * * * *